US006886309B2

(12) United States Patent
Phillips

(10) Patent No.: US 6,886,309 B2
(45) Date of Patent: May 3, 2005

(54) CUSTOM-DECORATED GIFTWRAP, KIT, AND METHOD OF AND SYSTEM FOR CUSTOM-DECORATING THE GIFTWRAP

(76) Inventor: Charles Phillips, 26 New York Ave., White Plains, NY (US) 10606

( * ) Notice: Subject to any disclaimer, the term of this patent is extended or adjusted under 35 U.S.C. 154(b) by 55 days.

(21) Appl. No.: 10/262,109

(22) Filed: Sep. 30, 2002

(65) Prior Publication Data

US 2003/0089083 A1 May 15, 2003

Related U.S. Application Data

(60) Provisional application No. 60/350,559, filed on Nov. 13, 2001.

(51) Int. Cl.[7] ..... B65B 11/48

(52) U.S. Cl. ..... 53/411; 53/131.4; 53/461; 493/188; 493/267; 229/87.19; 229/923; 428/542.6; 428/543; 428/913.3; 270/1.02; 270/4; 101/483; 283/117

(58) Field of Search ..... 493/188, 243, 493/264, 267; 53/411, 461, 131.4, 131.5; 229/87.18, 87.19, 922, 923; 162/263; 428/542.6, 543, 913.3; 270/4, 5.01, 1.02, 1.03; 101/483, 484, 485; 283/106, 117

(56) References Cited

U.S. PATENT DOCUMENTS 5,067,305 A * 11/1991 Baker et al. ..... 53/411
5,107,656 A * 4/1992 Katz et al. ..... 53/131.4
5,444,961 A * 8/1995 Doane et al. ..... 53/411
5,638,666 A * 6/1997 Davidov ..... 53/569
5,667,210 A * 9/1997 DeLise, Jr. ..... 270/37
5,794,409 A * 8/1998 Akridge et al. ..... 53/460
5,897,733 A * 4/1999 Stevens ..... 156/227
6,115,999 A * 9/2000 Adelman ..... 53/465
6,409,075 B1 * 6/2002 Mehta et al. ..... 229/92.1
6,592,022 B1 * 7/2003 Kamoi ..... 229/75
6,601,756 B2 * 8/2003 Hill et al. ..... 229/92.1
6,615,714 B2 * 9/2003 Miyazaki ..... 101/35
2002/0093191 A1 * 7/2002 Feng et al.
2003/0147683 A1 * 8/2003 Sesek
2003/0166443 A1 * 9/2003 May
2003/0227652 A1 * 12/2003 Masaki

FOREIGN PATENT DOCUMENTS

JP 2003-150727 A * 5/2003 ..... G06F/17/60

* cited by examiner

*Primary Examiner*—Scott A. Smith
*Assistant Examiner*—Gloria R. Weeks
(74) *Attorney, Agent, or Firm*—Kirschstein, et al.

(57) ABSTRACT

A custom-decorated giftwrap is made by feeding a folded sheet into a printer, while avoiding paper jams therein by holding together sheet portions of the sheet.

8 Claims, 2 Drawing Sheets

CUSTOM-DECORATED GIFTWRAP, KIT, AND METHOD OF AND SYSTEM FOR CUSTOM-DECORATING THE GIFTWRAP

CROSS REFERENCE TO RELATED APPLICATIONS

This application claims the benefit of U.S. Provisional Patent Application Ser. No. 60/350,559, filed Nov. 13, 2001.

BACKGROUND OF THE INVENTION

1. Field of the Invention

The present invention generally relates to a custom-decorated giftwrap, a kit for making the giftwrap, and a method of and a system for custom-decorating the giftwrap.

2. Description of the Related Art

Gift wrapping generally involves tearing a selected length of decorative paper from a supply roll, and snugly fitting it around a gift box, typically after multiple cutting, shaping, folding and taping operations. The supply roll paper bears printed decorations designed by the paper manufacturer. One must have many supply rolls having different decorations to be able to meet the need to wrap gift boxes for many different occasions. Even if one were able to select from among a multitude of such supply rolls, the decorations on the selected roll are still not unique to the gift recipient but, by necessity, need to be somewhat generic because the paper manufacturer wishes to sell a decorative paper having a wide appeal to the public at large.

It is known to custom-decorate various products with the aid of a programmable computer using design software that enables a computer operator to create and print a custom creation. Such products include party invitations, greeting cards, gift and name cards, postcards, business cards, decals, puzzles, iron-on transfers, magnets, albums, calendars, mousepads, etc. What all these products have in common is that they are fed as, or on, a flat, single sheet into a sheet-fed printer, such as an ink jet printer. The sheet is of conventional paper stock size, e.g., 8½"×11" (letter size), 8½"×14" (legal size), or 8.3"×11.7" (A-4 metric size). These sizes represent limiting factors in terms of the maximum size of a custom-decorated product.

In the case where a printed product larger than such paper stock sizes is desired, for example, in printing a poster, it is known to print out separate, multiple sheets of conventional size, and then to tape the separate sheets together in a tiled relationship to create the poster. However, the taping together of separate sheets is inelegant and while perhaps, by necessity, acceptable in a poster, is not satisfactory for a gift wrap where an elegant gift presentation is paramount. It is also known to print a banner on paper having a standard width, but whose length is determined by having a user tear the paper along score lines provided at spaced intervals lengthwise of the paper. However, such paper does not have clean sharp edges along the tear line.

It is further known to print large area sheets on wide format printers that are designed to handle such large sheets. For example, photographic quality glossy paper having sizes of 17"×22" (ANSI-C size) are fed as flat, single sheets into special purpose printers to create posters, calendars, and photographic presentations. It is also known to print on panoramic photo paper having sizes of 8.3"×23.4".

Other methods of printing on paper products and making paper products are disclosed in U.S. Pat. Nos. 4,996,184, 5,887,366 and 6,095,919.

SUMMARY OF THE INVENTION

OBJECTS OF THE INVENTION

One object of this invention is to provide a custom-decorated giftwrap unique to the recipient, a kit for making the giftwrap, and a method of and a system for custom-decorating the giftwrap.

Another object of this invention is to enable a computer user, especially in the home, to easily create a unique giftwrap for use in wrapping a gift box.

Still another object of this invention is to enable a gift giver to assist a gift recipient in celebrating a special occasion in style with a personalized, gift-wrapped present.

FEATURES OF THE INVENTION

In keeping with these objects, and others which will become apparent hereinafter, one feature of this invention resides, briefly stated, in a method of and a system for custom-decorating giftwrap, in which a foldable sheet is formed with a plurality of integral sheet portions or panels, each having a width commensurate with a width of conventional paper stock, for example, eight and one-half inches, and a length longer than a length of conventional paper stock, for example, eleven inches.

According to this invention, at least one of the sheet portions is folded about a fold line over another of the sheet portions so that the overlapping sheet portions are of equal area. Preferably, two outer sheet portions are folded over a central sheet portion in a C-shaped folded configuration about two mutually parallel fold lines. The folded sheet portions are maintained in a closed state. For example, an adhesive may be applied to an area of one of the overlapping sheet portions. Adhesive contact is made between the overlapping sheet portions, typically by pressing them together. Preferably, the adhesive is a pressure-sensitive light adhesive capable of maintaining the overlapping sheet portions together in the closed state, and of enabling the sheet portions to be easily peeled apart to an open state. Preferably, the adhesive is applied along peripheral free edges of the sheet portions, either at selected zones or continuously along the free edges. Alternatively, a double-sided adhesive carrier can be placed between the overlapping sheet portions. Also, a single-sided adhesive tape can be adhered exteriorly around the overlapping sheet portions to adhere them in the closed state.

Instead of an adhesive, a tacky, non-slip coating, or any friction-enhancing substance, can be applied between the overlapping sheet portions to hold them in the closed state.

The folded sheet, with the overlapping sheet portions maintained together in the closed state, is fed in a longitudinal direction of insertion into a sheet-fed printer of the type used at home, which is controlled by a programmable computer. Each fold extends along the longitudinal direction. A computer operator designs a custom decoration on the computer with the aid of a design program, either sold separately or as part of the kit. The custom decoration is thereupon printed on the folded sheet. The folded sheet may also be preprinted with some indicia.

The size of the printed sheet is no longer limited to conventional paper stock sizes. Printing is performed on each sheet portion and multiple printings may be performed on each sheet portion. When unfolded, the printed sheet is much larger in area than the conventional paper stock.

Heretofore, as far as I am aware, longitudinally folded paper was never longitudinally fed into the printer. The reason is that paper jams would inevitably occur as the automatic feeder of the printer tended to preferentially grab one of the sheet portions, while leaving another sheet portion behind. Paperjams occur all too frequently in a stack of separate sheets—a situation made all the more worse if two adjacent sheets were connected together along a fold. Hence, oversized printed sheets, i.e., larger in area than the conventional stock sizes, were not printed and, as a result, could not be used as a giftwrap since the gift wrapping of most gift boxes requires an oversized sheet.

The use of the adhesive, tacky coating, or friction-enhancing substance to maintain the sheet portions together according to this invention avoids the aforementioned paper jamming drawback since the sheet portions travel as a unit through the printer and provide a consistent paper feed through the printer. Also, in the case of a sheet having more than one fold such as the C-shaped configuration described above, it is sometimes possible to eliminate the adhesive, coating, or substance altogether, since the interleaved sheet portions tend to hold themselves in place. A custom-decorated giftwrap can now be easily designed and used to enable special occasions to be celebrated in style with a personalized decoration unique to the recipient, and not dictated by the paper manufacturer.

The novel features which are considered as characteristic of the invention are set forth herein. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 3:
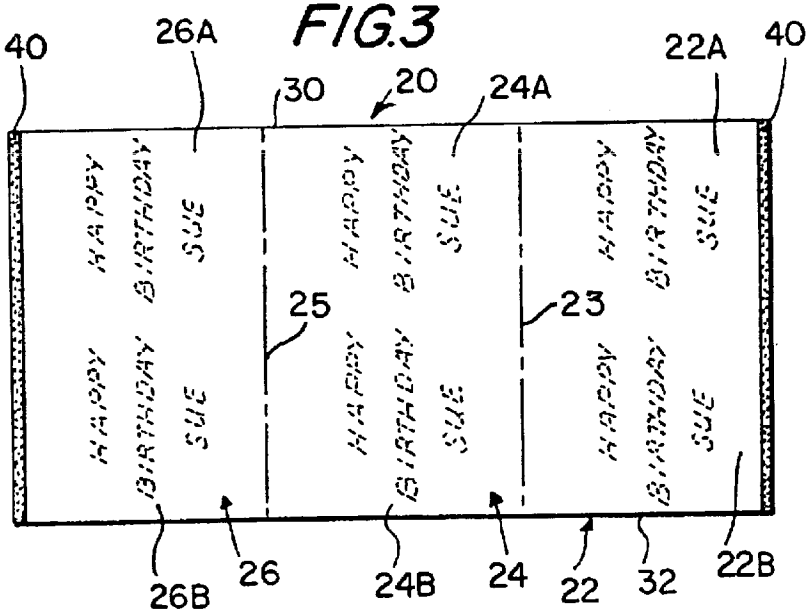
FIG. 3 is a top plan view of the giftwrap after printing.
Figure 4:
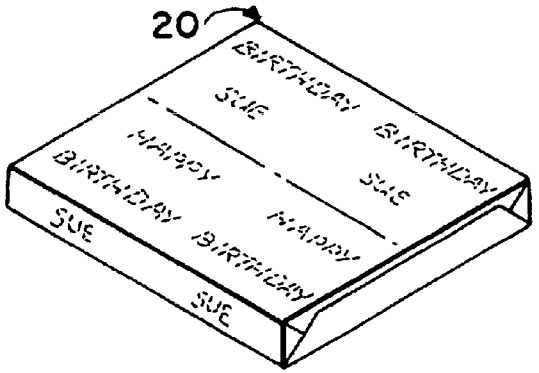
FIG. 4 is a perspective view of the giftwrap of FIG. 3 after being wrapped about a gift box.

Reference numeral 10 depicts an inkjet printer of conventional design and connected to a computer 12. A folded sheet 20 is depicted during insertion into a paper loading tray 14 of the printer. As explained below, the folded sheet 20 will be printed with a custom decoration, e.g., multiple printings of the designation "Happy Birthday Sue", to form the giftwrap depicted in FIG. 3. Thereupon, the giftwrap is fitted around a giftbox, as shown in FIG. 4, to complete the personalized gift presentation.

Figure 2:
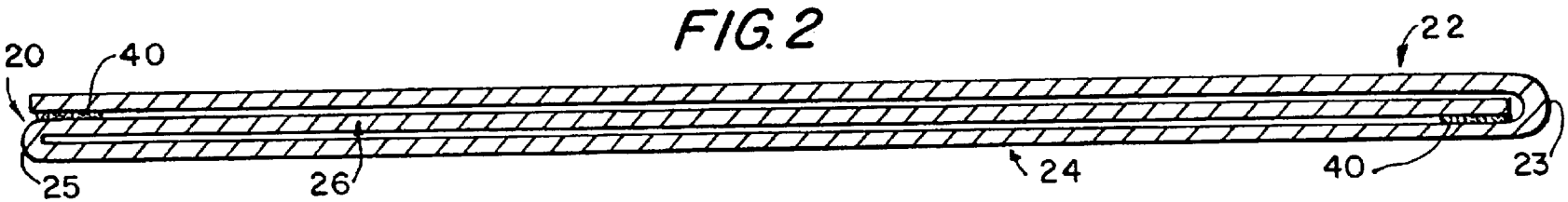
FIG. 2 is a sectional view taken on line 2—2 of FIG. 1.
Figure 1:
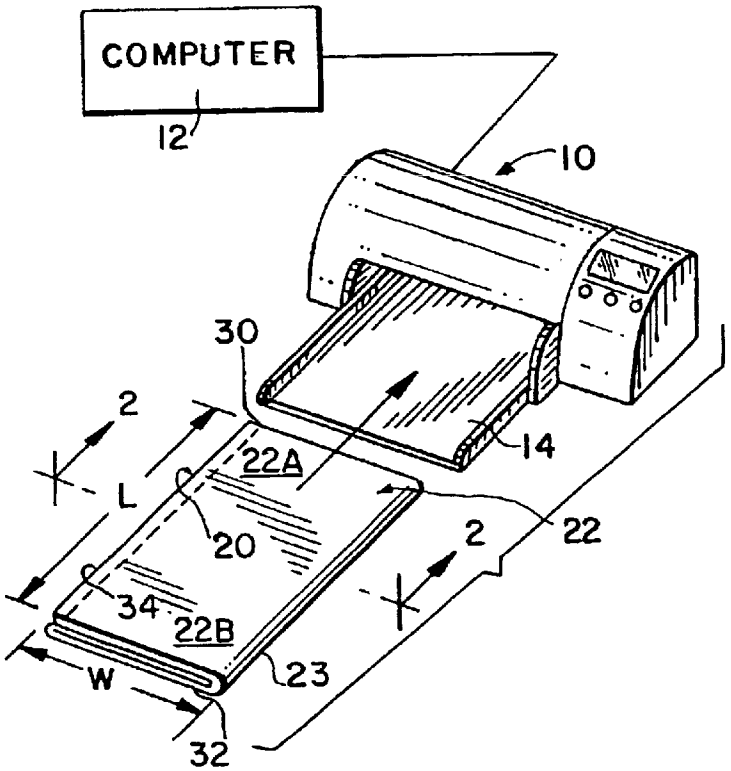
FIG. 1 is a perspective view of one embodiment of a folded sheet being fed to a printer during the making of a giftwrap according to this invention.

The printer 10, which could also be a laser jet printer, is of the size and type commonly found at home, wherein the maximum paper width (W) is 8½". The folded sheet 20 has at least two panels or sheet portions, namely an upper sheet portion 22 and a lower sheet portion 24, both of equal area and folded about a longitudinal fold line 23 to overlap each other. Preferably, the folded sheet 20 has a third panel or sheet portion, namely middle sheet portion 26, of equal area to the other sheet portions and folded about a longitudinal fold line 25 to overlap the lower sheet portion. As shown in FIG. 2, the preferred embodiment of the folded sheet has a C-shaped configuration, with the middle sheet portion 26 being sandwiched between the upper and lower, outer sheet portions 22, 24.

The folded sheet is constituted of a single sheet of paper, preferably having a photograde quality, glossy coating on an exterior surface, and a plain non-coated, opposite interior surface. Upper sheet portion 22 has leading and trailing sections 22A, B. Lower sheet portion 24 has leading and trailing sections 24A, B. Middle sheet portion 26 has leading and trailing sections 26A, B. Folded sheet 20 has a length (L) which is the sum of the lengths of the sections 22A, B or 24A, B or 26A, B. Each section is of conventional stock size, i.e., 8½"×11", 8½"×14", or 8.3"×11.7". Hence, the length L of the folded sheet 20 is 22", 28" or 23.4".

Folded sheet 20 has transverse leading edge regions 30, transverse trailing edge regions 32, and longitudinal side edge regions 34 at its peripheral regions. A pressure-sensitive adhesive 40 is applied to selected zones along the peripheral regions on interior surfaces of the folded sheet. The zones can be individual adhesive spots spaced apart from one another, or a continuous strip. The adhesive can be applied at one or more of the edge regions 30, 32, 34. The adhesive is preferably a light tacky adhesive of the type marketed by the 3M Company in its POST-IT™ notepads and is capable of adhering the upper, lower and middle sheet portions 22, 24, 26 together in a closed state (FIG. 2) suitable for printing, and of enabling the upper, lower and middle sheet portions to be peeled apart to an open state (FIG. 3) suitable for gift wrapping.

Instead of applying the adhesive 40 directly to the interior surfaces of the folded sheet, a double-sided adhesive carrier can be inserted between the sheet portions 22, 24, 26 to maintain them in the closed state after being pressed together. Also, a single-sided tape can be wrapped around the exteriors of the sheet portions 22, 24, 26 to maintain them in the closed state. Preferably, the tape is positioned at the leading and trailing corners of the sheet portions that are furthest away from each fold. However, the tape could also be positioned along the transverse leading and trailing edge regions 30, 32, either entirely, or at spaced-apart zones, along the regions 30, 32.

Instead of an adhesive, any tacky or non-slip coating, or friction-enhancing substance, could be employed. In some cases, the use of the adhesive, coating or substance can be eliminated, especially in the case of a sheet having multiple, interleaved sheet portions which tend to hold one another in place by surface area contact.

Figure 6:
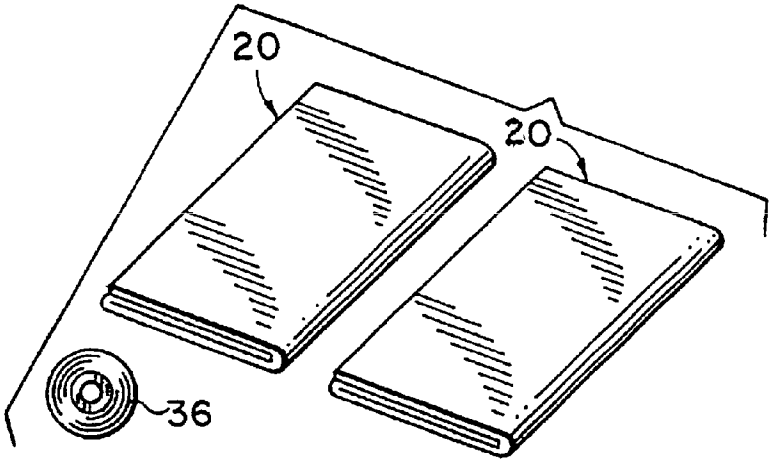
FIG. 6 is a perspective view of a giftwrap kit according to this invention.

FIG. 6 depicts a kit including at least one sheet 20, and preferably a plurality of sheets 20, preferably prefolded and already applied with the adhesive 40 or like holder. The kit also includes a software program, shown on a compact disc 36, which when loaded onto the computer 12, enables the operator to design and create a personalized decoration. This program is analogous to the myriad conventional design programs for creating designs on greeting cards.

Once the personalized decoration has been custom-made for the gift recipient, the folded sheet 20 is fed along the longitudinal direction into the tray 14 so that the section 22A is printed first with the decoration. Thereupon, the folded sheet is turned around by 180°, and fed into the tray 14 so that section 22B is printed next. Thereupon, the folded sheet is turned upside down so that section 24A is printed. Thereupon, the folded sheet is turned around by 180° so that section 24B is printed. Next, the middle sheet portion is exposed from its sandwiched position by folding the upper sheet portion 22 upwardly out of the way to a first vertical position, by folding the middle sheet portion 26 upwardly out of the way to a second vertical position which is parallel to the first vertical position, by laying the upper sheet portion 22 down onto the lower sheet portion 24, and by laying the middle sheet portion 26 down onto the upper sheet portion 22. Then, the exposed middle sheet portion is fed in opposite directions through the printer to separately print on sections 26A, 26B. The giftwrap of FIG. 3 is created by feeding the folded sheet six times through the printer, once for each section. It is currently preferred to print sections 22A,B, sections 24A,B, and sections 26A,B in three respective passes through the printer.

Figure 5:
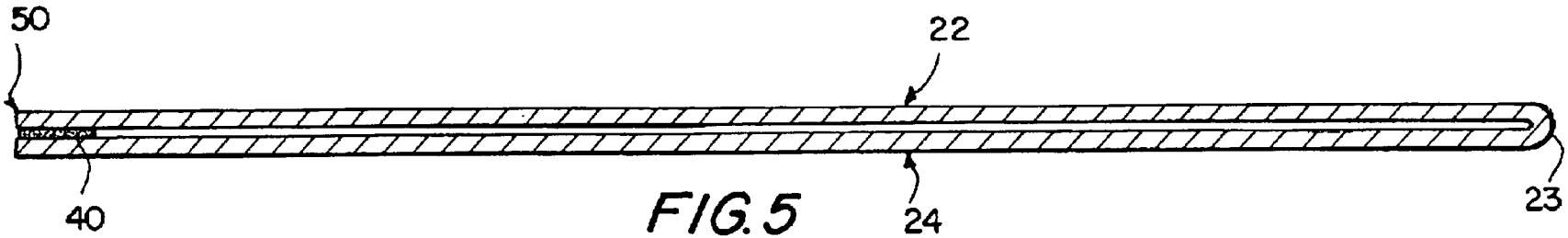
FIG. 5 is a view analogous to FIG. 2, but of another embodiment.

If each section of the folded sheet 20 in FIG. 3 measures 8½"×11", then the overall unfolded sheet measures 25½"×22" which is adequate for many gift-wrapping purposes. If legal size paper is used, then the overall dimensions of the unfolded sheet measures 25½"×28". If still larger gift-wraps are desired, then instead of using a double folded sheet as depicted in FIG. 2, one can use a triple folded sheet, or a sheet with more than three folds. For a smaller gift wrap, a single folded sheet 50 having upper and lower sheet portions 22,24 foldable about a single fold line 23 may be used. Again, the adhesive 40 or like holder may be used to hold the sheet portions together, as depicted in FIG. 5.

It will be appreciated that printing is performed on a single piece of paper larger than stock sizes without having to tape together a plurality of separate sheets, without having to tear banner paper to a selected length, without having to use wide format printers that can handle large format paper, as well as without incurring paper jams in the printer since the folded sheet passes through the printer in a folded, closed condition.

Variations of the invention include folding the sheet with more than two longitudinal folds to achieve even larger sized gift-wraps, using material other than paper as the media to be printed, using a floppy disc instead of the compact disc 36 to store the program, and eliminating the software program entirely and using a graphics program already installed on most home computers, or by accessing a graphics program accessible at a website on the Internet. The decoration itself is left to the operation's imagination and need not be limited to the textual message described above. Indeed, any images, including photographs, already stored on the computer can be imported and printed on the folded sheet Some indicia can be preprinted on the sheet.

Still another variation of this invention is to vary the length L of the folded sheet 20. As described, the length is two times the length of a stock sheet, since there are two sections 22A,B; 24A,B; and 26A,B for the sheet portions 22, 24 and 26. The length is, in the preferred embodiment, three times the length of a stock sheet, and each sheet portion is comprised of three sections. For an 8½×11" stock sheet, the length L of such a folded sheet 20 is 33".

As mentioned, it is preferred if the sheet is prefolded and precoated with the adhesive. Nevertheless, it is also contemplated that the user may wish to perform these functions by being provided with double-sided adhesive carriers, or single-sided adhesive tapes, and by being instructed to position the carriers or tapes on the prefolded sheet. The user may even be instructed to fold the sheet itself.

It will be understood that each of the elements described above, or two or more together, also may find a useful application in other types of constructions differing from the types described above.

It will be appreciated that the instant invention need not be limited to applications involving gift wrapping, since the printing on a folded sheet can have myriad other applications. For example, one may want to print a spreadsheet spanning a plurality of stock sheet pages using a conventional deskjet printer which can only accommodate the width of a single stock sheet. In this case, the folding of the sheet into a corresponding plurality of sheet portions and the holding together of the sheet portions during the feeding and printing operations, enables the oversized spreadsheet to be printed.

While the invention has been illustrated and described as embodied in a system and method for custom-decorating a giftwrap, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the present invention.

I claim:

1. A method of wrapping a custom-decorated giftwrap around an object, comprising the steps of:

a) folding a single sheet in a flat condition into a folded sheet having a longitudinal fold and overlapping integral sheet portions;

b) temporarily holding the sheet portions together to form a closed state for the folded sheet;

c) loading the folded sheet in the closed state along a longitudinal direction lengthwise of the fold in a sheet-fed printer, under control by a computer;

d) designing a custom decoration by using the computer;

e) printing the custom decoration on at least one of the sheet portions as the folded sheet in the closed state is fed, and passes without jamming, along the longitudinal direction through the printer during printing;

f) unfolding the folded sheet back to the single sheet in the flat condition to an open state by peeling the sheet portions apart; and g) covering the object with the unfolded sheet in the open state by initially placing the object on the unfolded single sheet in the flat condition, and thereupon fining the unfolded sheet around the object.

2. The method of claim 1, wherein the folding and holding steps are performed by a user.

3. The method of claim where in the folding and holding steps are performed by a manufacturer of the sheet.

4. The method of claim 1, wherein the designing step is performed by a user of the computer by accessing a design program loaded on the computer.

5. The method of claim 1, wherein the printing step is performed on each sheet portion during successive passes through the printer.

6. The method of claim 1, wherein the folding step is performed by folding the sheet portions to be of equal area.

7. The method of claim 1, wherein the holding step is performed by application of a pressure-sensitive adhesive on at least a selected zone between the sheet portions.

8. The method of claim 1, wherein the sheet-fed printer has a loading tray for receiving sheet stock having a maximum width, and wherein the folding step is performed by forming each sheet portion with a width commensurate to said maximum width.

* * * * *